US006027379A

United States Patent [19]

Hohorst

[11] Patent Number: 6,027,379

[45] Date of Patent: Feb. 22, 2000

[54] RAIL-MOUNTED TERMINAL BLOCKS HAVING LATERAL BRIDGING CONTACTS

[75] Inventor: Wolfgang Hohorst, Minden, Germany

[73] Assignee: WAGO Verwaltungsgesellschaft mbH, Minden, Germany

[21] Appl. No.: 08/977,349

[22] Filed: Nov. 24, 1997

[30] Foreign Application Priority Data

Nov. 28, 1996 [DE] Germany ..... 196 50 989

[51] Int. Cl.[7] ..... H01R 9/22

[52] U.S. Cl. ..... 439/715

[58] Field of Search ..... 439/715, 709, 439/710, 712–16, 717, 76.1

[56] References Cited

U.S. PATENT DOCUMENTS 4,548,448 10/1985 Ellison et al. ..... 439/709

5,716,241 2/1998 Hennemann et al. ..... 439/716

5,836,791 11/1998 Waas et al. ..... 439/709

FOREIGN PATENT DOCUMENTS 42 31 625 A1 3/1994 Germany .

*Primary Examiner*—Steven L. Stephan
*Assistant Examiner*—Eugene G. Byrd
*Attorney, Agent, or Firm*—Salter & Michaelson

[57] ABSTRACT

The invention relates to an electrical series terminal with lateral bridging contacts which automatically make an electrical connection between adjacent series terminals when the series terminal comes to rest on a load-bearing rail. It is proposed that terminals additionally be docked on the front surface of such series terminals, whereby these additional terminals automatically contact a frontal docking contact on the series terminal which, for its part, is connected to an assigned lateral bridging contact on the series terminal.

5 Claims, 1 Drawing Sheet

RAIL-MOUNTED TERMINAL BLOCKS HAVING LATERAL BRIDGING CONTACTS

BACKGROUND AND SUMMARY OF THE INVENTION

The invention relates to a series terminal, whereby several such terminals are capable of being brought to rest adjacently to one another, via their lateral surfaces, on a load-bearing rail and whereby each has a housing, which comprises an insulating substance, with an upper visible surface or front surface through which the series terminal's connections for connecting electrical conductors are accessible via front wiring. The series terminal's housing, which comprises an insulating substance, has a front and a rear upper surface between which the depth of the terminal is measured transversely to the longitudinal direction of the load-bearing rail and lateral bridging contacts are present on, or in, the lateral surfaces of the housing, which comprises an insulating substance, whereby the lateral bridging contacts automatically make an electrical connection between adjacent series terminals when the series terminal comes to rest on a load-bearing rail.

Series terminals with lateral bridging contacts are known, for example, from DE 4,402,002 A1. The series terminals, which are described there, are used as so-called input/output modules at the interface between a central computer for measuring (monitoring), controlling and regulating of machines, apparatus or plants and the sensors and actors which are arranged in a decentralized manner in the field, i.e. in the machine, on the apparatus or in the plant.

The transport of data between the central computer and the sensors/actors in the field takes place via one or more data bus lines. For this purpose, the sensors/actors are connected to the data bus by means of I/O. As a rule, this is initially a sub-bus which, for its part, is connected to a master field bus via a bus connector, whereby the master field bus transports the data from, or to, the central computer.

The digital or analog signals which are associated with the sensors/actors, that are used on the field side, are converted into bus-amenable data for the data bus (or conversely) by means of the electronics (i.e. the so-called internal electronics of the series terminal or, as the case may be, the I/O module) which are incorporated in, or which are plugged into, the series terminal. In this regard, the field side usually communicates with the bus side via an optical connector, i.e. the field side is galvanically separated from the bus side.

The series terminal does not have any wiring connections on the bus side. Lateral bridging contacts are present on, or in, the lateral surfaces of the housing, which comprises an insulating substance, whereby the bridging contacts automatically make an electrical connection for data transport and for the supply of current to the internal electronics when the series terminals come to rest on a load-bearing rail. As a rule, a series terminals of this type possesses two lateral contacts for the supply of current to the internal electronics (plus and minus, e.g. 5 V DC) and two to four additional lateral contacts for the transport of data.

On the field side, the series terminal has various terminal connections for the direct connection of the signal lines for each of the sensors/actors and their supply lines (e.g. a plus conductor and a minus conductor as well as a PE conductor and also a shielded conductor if required). If the series terminal has a PE connection or a shielded conductor connection, then this is usually automatically connected to the load-bearing rail (in the form of a collector line) when the series terminal comes to rest on a load-bearing rail.

The field side supply of current for the sensors/actors (e.g. 24 V DC or e.g. 230 V AC) is carried out by means of a special series terminal (a so-called feed terminal) from which the transverse distribution of the supply of current to the individual series terminals again takes place via lateral bridging contacts, whereby the bridging contacts are present on, or in, the lateral surfaces of the series terminals's housing, which comprises an insulating substance, and which automatically make an electrical connection between adjacent series terminals when the series terminals come to rest on a load-bearing rail.

The large number of terminal connections, which are required in the case of series terminals of this type and which vary depending on the application in question and the type of sensors/actors which are used, considerably increases the external dimensions of series terminals, especially the depth of the terminal when measured transversely to the longitudinal direction of the load-bearing rail. This is disadvantageous for the arrangement and installation of series terminals in a manner which would otherwise conserve space.

The task of the invention is to reduce the external dimensions of series terminals, despite the large number of terminal connections, which are desired for the most widely differing applications.

In accordance with the invention, this problem is solved by way of the feature that the front and/or rear upper surface of the series terminal's housing, which comprises an insulating substance, has a mechanical docking device for at least one additional terminal (a so-called docking terminal) which, during the mechanical docking process, automatically contacts at least one electrical frontal contact which is present on, or in, the upper surface of the housing, which comprises an insulating substance, and that the docking upper contact on, or in, the frontal surface of the housing, which comprises an insulating substance, is electrically connected to an associated lateral bridging contact on, or in, the lateral surface of the series terminal's housing which comprises an insulating substance.

The idea of a docking terminal involves the aspect that, in the overwhelming majority of all applications, series terminals of the aforementioned type require only a basic configuration of terminal connections and that the series terminal can be constructed with considerably smaller dimensions in this basic configuration than if the basic configuration of the terminal connections is accommodated within a dimension of the housing, which comprises an insulating substance, which considerably shortens the depth of the terminal when measured transversely to the longitudinal direction of the load-bearing rail. The docking terminal has to be used only for an additional terminal connection.

For example, it has become quite usual today to completely encapsulate sensors and/or actors, which are present in the field, in a housing, which comprises an insulating substance, so that the PE conductor can be dispensed with. The series terminal does not then have to provide a PE connection and can thus be constructed with smaller dimensions.

The same considerations apply to a shielded connection. This is also required in only a small number of applications and can be retrofitted via a docking terminal.

Docking terminals in accordance with the teaching of the invention can also be retrofitted for an additional current-carrying conductor if a special application makes such an additional terminal connection necessary.

The retrofitting of a docking terminal is always a special case which does not affect the majority of applications of such series terminals so that, in the majority of applications, the small construction of the basic configuration of the series terminal (without a docking terminal) brings about considerable savings in space with the arrangement and installation of such terminals in, or on, machines, apparatus, in switch boxes or similar devices.

These savings in space must also be preserved for the majority of all applications of the series terminals when the special case of retrofitting applies to a few series terminals which are arranged in a block of terminals on a load-bearing rail, e.g. with a PE connection, a shielded conductor connection or an additional current connection. In such a case, it would be extremely disadvantageous if, in the case of such an individual terminal, the retrofitted docking terminal had to be integrated into the adjacent docking terminals of the other series terminals.

The solution that forms the basis of the invention therefore provides for the electrical connection of the docking frontal contact on, or in, the upper surface of the series terminal's housing, which comprises an insulating substance, to an associated lateral bridging contact on, or in, the lateral surface of the series terminals' housing which comprises an insulating substance. As a result of this, one ensures that, even in their basic configuration, all the series terminals of the type in accordance with the invention always provide a transverse electrical connection for docking a docking terminal independently of whether this transverse connection is exploited through all adjacent series terminals by docking one individual docking terminal.

It is only this transverse connection (or transverse distribution) of a potential, which is made when the series terminal comes to rest on a load-bearing rail, which makes it possible for the user to be able to select an additional terminal connection without problems and at any time, i.e. even subsequently, by docking a docking terminal without the savings in space having to be given up in the case of the other series terminals, which are installed in the basic configuration, or without impairing these savings in space.

An especially advantageous form of embodiment of the invention provides for the docking device to be formed via one or two guidance rails, which are formed at the upper surface of the housing that comprises an insulating substance, whereby the docking terminal is capable of being slotted into the guidance rails, via a corresponding rail-shaped profile, starting from the upper surface of the series terminal.

Such a docking device, which is capable of being guided by a rail and which is capable of being operated from the upper surface of the series terminal, has the advantage (in contrast to docking devices which are capable of being plugged in) that an additional terminal connection at the frontal surface of a series terminal can still be docked when the series terminal has already been installed in a compact arrangement relative to the other series terminals, e.g. in a switch box or a similar device.

In this regard, one can also provide for two or more docking terminals to be capable of being slotted into the docking guidance rails at the front and for these to be capable of being positioned at various heights. A separate docking frontal contact is then present at each height in the frontal surface of the series terminal's housing, which comprises an insulating substance, whereby the two docking frontal contacts are each capable of being electrically connected to a separate associated lateral bridging contact or to a communal lateral bridging contact on, or in, the lateral surface of the series terminal's housing which comprises an insulating substance.

In the surface of the series terminal's housing, which comprises an insulating substance, one constructs a docking terminal with 2-poles in a housing, which comprises an insulating substance, with a frontal contact for each pole and that one constructs the series terminal in a corresponding manner with two docking frontal contacts, whereby the two docking frontal contacts are again electrically connected to their own lateral bridging contact on, or in, the lateral surface of the series terminal's housing which comprises an insulating substance.

The invention provides for a docking contact on the frontal surface of the series terminal's housing, which comprises an insulating substance, being additionally connected to the load-bearing rail of the series terminal.

The teaching in accordance with the invention in regard to the frontal docking of additional docking terminals on series terminals excels by virtue of the feature that it can be realized in conjunction with any series terminal independently of whether the series terminal—in the form of an I/O module for bus systems—has internal electronics (see DE 4,402,002 A1) in this regard) or whether one is dealing with a traditional series terminal for standard wiring problems without an electronic part. The advantages of the savings in space for the majority of all applications are also provided in the latter case.

BRIEF DESCRIPTION OF THE DRAWINGS

Examples of embodiments of the invention are described in more detail below on the basis of the drawings. The following aspects are shown.

DETAILED DESCRIPTION

Figure 1:
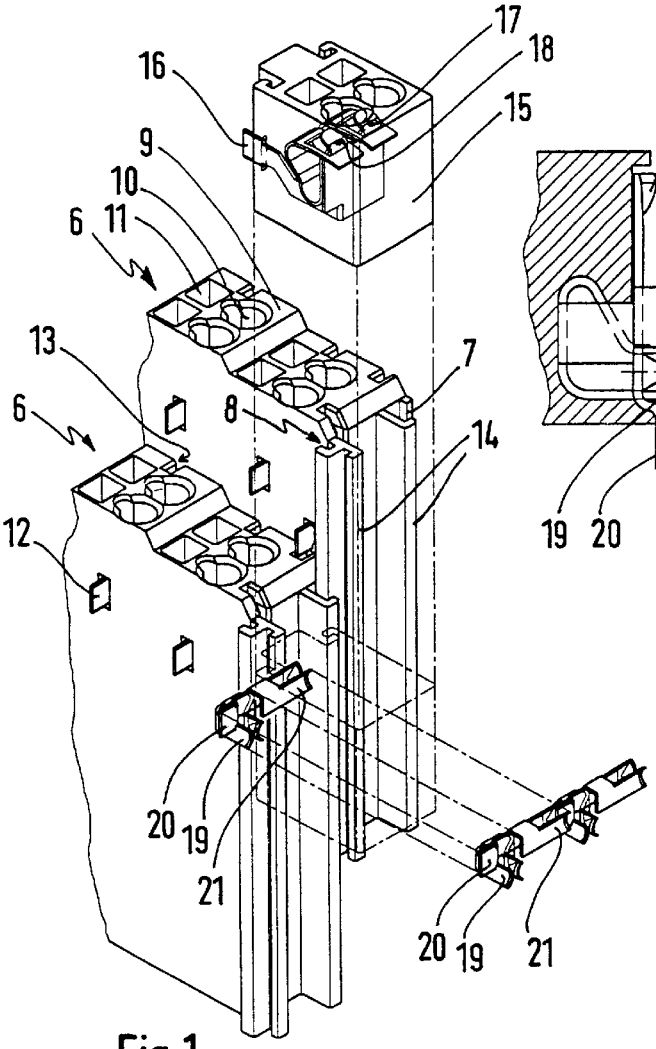
FIG. 1 shows a perspective illustration of series terminals in accordance with the invention.

FIG. 1 shows the frontal end regions of two series terminals 6 in the form of a perspective illustration. Such series terminals 6 are brought to rest adjacently to one another on a load-bearing rail in a way which is known and which is therefore not illustrated further.

Figure 3:
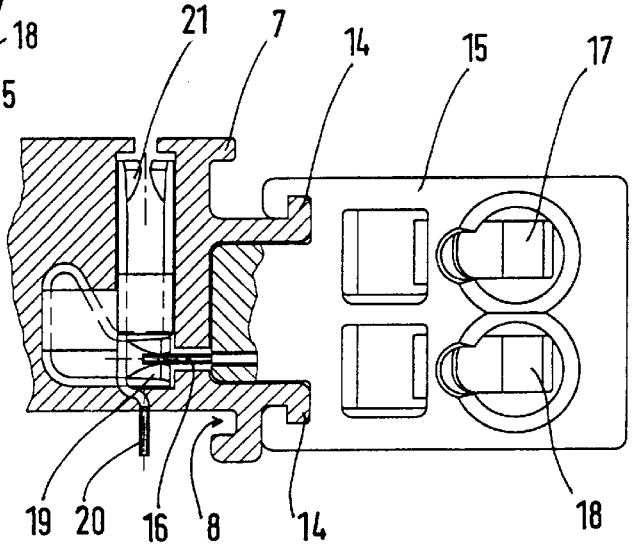
FIG. 3 shows a cross section through the series terminal with a docking terminal.

The bringing to rest of the series terminals on the load-bearing rail takes place in a vertical direction in accordance with the illustration, whereby the projection 7 and the recess 8 of adjacent series terminals engage with one another on the frontal surfaces of the series terminal (see also FIG. 3 in this regard), in order to firmly connect the series terminals mechanically to one another in the sequential direction of joining the terminals on the load-bearing rail. This is also known.

The terminal connections are accessible via the series terminals' upper frontal surface, i.e. the so-called upper surface 9, which includes front upper surface 9*a* and rear upper surface 9*b* which is turned toward the operator, whereby the terminal connections are arranged in the interior of the housing, which comprises an insulating substance, but are not illustrated further since one is dealing here with known terminal connections for electrical conductors which are constructed, for example, in the form of terminal connections, which operate via the force of springs, or in the form of screw-type connections. Each terminal connection is assigned an opening 10 for introducing the conductor and an actuation opening 11.

It is known that one can provide lateral bridging contacts on the lateral surfaces of the series terminal's housing, which comprises an insulating substance, e.g. a knife contact 12 on one side, whereby the knife contact projects from the lateral surface, and a fork contact 13 on the other side which is arranged to be sunken into the lateral surface. The two bridging contacts 12 and 13 are positioned in such a way that they automatically make an electrical connection between the adjacent series terminals when the series terminals are brought to rest adjacently to one another on a load-bearing rail.

In accordance with the invention, the series terminals 6, which are illustrated, are each provided with a mechanical docking device on the front surface of their housing, which comprises an insulating substance, whereby the mechanical docking device is in the form of two guidance rails 14. A docking terminal 15 is capable of being slotted onto these guidance rails 14 via a corresponding rail-shaped profile, i.e. vertically from above in accordance with the illustration and starting from the series terminal's front surface 9 which is turned toward the operator.

The docking terminal 15 has a front contact 16 on its side which lies opposite the series terminals's upper surface (in the example of an embodiment which is illustrated, this front contact 16 is in the form of a knife contact), whereby this front contact is electrically connected to the two terminal connections 17 and 18 which are present in the housing of the docking terminal 15, which comprises an insulating substance, and each are accessible via associated openings for introducing a conductor and actuation openings. During the mechanical docking process, the front contact 16 automatically contacts a frontal docking contact 19 which is present on the front surface of the housing of the series terminal 6 which comprises an insulating substance (in the case of this example of an embodiment, this front docking contact is in the form of a fork contact). The collaborative action on the docking terminal of the front contact 16 (knife contact) with the frontal docking contact 19 (fork contact) on the front surface of the series terminal is shown more exactly in FIG. 3.

Figure 2:
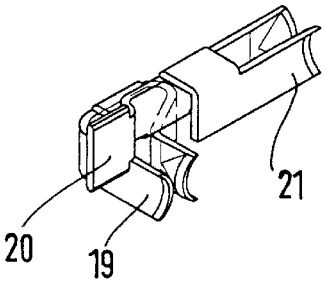
FIG. 2 shows the front and lateral contacts in a single illustration.

FIG. 2 shows the frontal docking contact 19 in the form of a perspective illustration in the expanded state whereby, in accordance with the invention, this contact is electrically connected to the two lateral bridging contacts 20 and 21. In the case of the example of an embodiment which is illustrated, the contacts 19, 20 and 21 are formed in one piece from sheet metal in such a way that the knife contact 20 projects in the form of a lateral bridging contact on one lateral surface of the series terminal's housing which comprises an insulating substance (in this regard, see also FIGS. 1 and 3) and also in such a way that the contact fork 21 is arranged in the form of a lateral bridging contact in a sunken manner in the other lateral surface of the housing which comprises an insulating substance. When the series terminals come to rest on a load-bearing rail, an electrical connection pathway is made through all the series terminals, which have come to rest adjacently to one another on the load-bearing rail, via the lateral bridging contacts 20 and 21.

Figure 4:
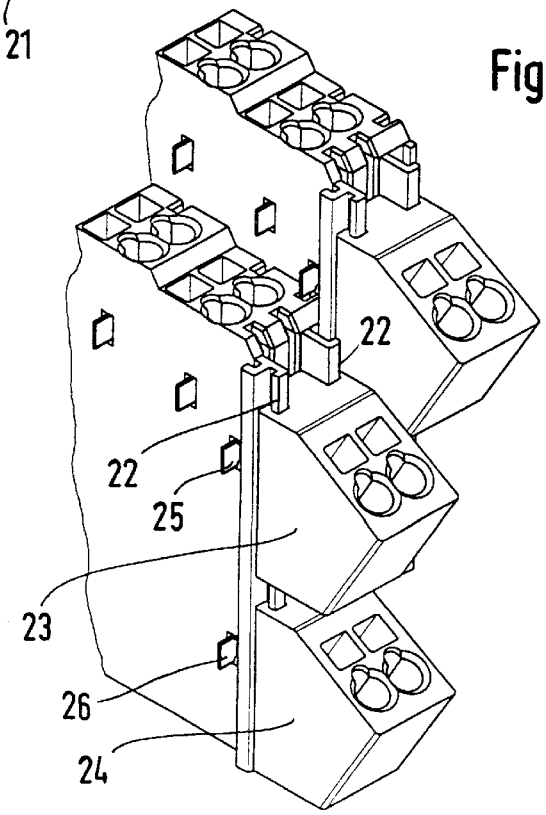
FIG. 4 shows a second example of an embodiment of the series terminal in accordance with the invention.

FIG. 4 shows a form of embodiment of the invention in the form of a perspective illustration, in which two docking terminals 23 and 24 are capable of being slotted one over the other into the front docking guidance rail 22, whereby two connection pathways, which are electrically independent of one another, are present through all adjacent series terminals via the lateral bridging contacts 25 and 26 and each docking terminal is electrically connected only to the lateral bridging contact which is assigned to it.

I claim:

1. A series terminal comprising:

an insulating housing which is constructed and arranged for engaging a support rail and for engaging adjacent series terminals along lateral surfaces thereof, said housing including a front surface, an upper surface and a number of lateral bridging contacts disposed on the lateral surfaces of the housing, said lateral bridging contacts electrically connecting adjacent series terminals when said lateral surfaces of the adjacent series terminals are engaged; and a discrete docking terminal including a number of apertures which provide access to connection terminals within said docking terminal for connecting electrical conductors, and a docking contact electrically connected to said connection terminals;

said upper surface of said housing including a number of apertures which provide access to connection terminals within said housing for connecting electrical conductors;

said front surface of said housing including a docking device constructed and arranged for receiving said docking terminal and making electrical contact between said docking contact and at least one of said lateral bridging contacts.

2. The series terminal of claim 1, wherein said docking device includes at least one rail formed on said front surface of said housing and said docking terminal includes at least one corresponding rail for slidably mounting said docking terminal to said housing by engaging said corresponding rails.

3. The series terminal of claim 2, wherein said docking device is adapted to receive two or more docking terminals on said at least one rail.

4. The series terminal of claim 1, wherein said docking terminal comprises two connection terminals, each having a docking contact, and wherein said docking device includes lateral bridging contacts for electrically connecting each of said docking contacts to said series terminal.

5. The series terminal of claim 1, wherein said docking device includes a lateral bridging contact which is adapted to engage the support rail.

* * * * *